US012163272B2

(12) United States Patent
Choe

(10) Patent No.: US 12,163,272 B2
(45) Date of Patent: Dec. 10, 2024

(54) DRYER CONTROL METHOD

(71) Applicant: LG Electronics Inc., Seoul (KR)

(72) Inventor: Woonje Choe, Seoul (KR)

(73) Assignee: LG Electronics Inc., Seoul (KR)

( * ) Notice: Subject to any disclaimer, the term of this patent is extended or adjusted under 35 U.S.C. 154(b) by 775 days.

(21) Appl. No.: 17/415,478

(22) PCT Filed: Dec. 17, 2019

(86) PCT No.: PCT/KR2019/017869
§ 371 (c)(1),
(2) Date: Jun. 17, 2021

(87) PCT Pub. No.: WO2020/130567
PCT Pub. Date: Jun. 25, 2020

(65) Prior Publication Data

US 2022/0064848 A1 Mar. 3, 2022

(30) Foreign Application Priority Data

Dec. 18, 2018 (KR) ..... 10-2018-0164327

(51) Int. Cl.
*D06F 58/38* (2020.01)
*D06F 58/04* (2006.01)
(Continued)

(52) U.S. Cl.
CPC ..... *D06F 58/38* (2020.02); *D06F 58/04* (2013.01); *D06F 2101/20* (2020.02);
(Continued)

(58) Field of Classification Search
CPC ..... D06F 58/38; D06F 58/04; D06F 2105/48; D06F 2101/20; D06F 2103/08; D06F 2103/38
(Continued)

(56) References Cited

U.S. PATENT DOCUMENTS 4,891,892 A * 1/1990 Narang ..... D06F 58/20 34/86
9,359,713 B2 * 6/2016 Kang ..... D06F 33/52
(Continued)

FOREIGN PATENT DOCUMENTS

CN 101153455 4/2008
CN 104420148 3/2015
(Continued)

OTHER PUBLICATIONS

Office Action in Chinese Appln. No. 201980082312.2, dated Oct. 26, 2022, 17 pages (with English translation).
(Continued)

*Primary Examiner* — Stephen M Gravini
(74) *Attorney, Agent, or Firm* — Fish & Richardson P.C.

(57) ABSTRACT

The present invention relates to a dryer control method comprising: an air supply step for supplying air to a drum via an air supply unit; a first agitation step for controlling a drive unit so that the drum carries out a second motion and a third motion from when the air supply step begins until a preset reference time is reached; and a second agitation step for controlling the drive unit so that the drum carries out a first motion, the second motion and the third motion from when the reference time is reached until the completion of the air supply step.

9 Claims, 3 Drawing Sheets

(51) Int. Cl.
*D06F 101/20* (2020.01)
*D06F 103/08* (2020.01)
*D06F 103/38* (2020.01)
*D06F 105/48* (2020.01)

(52) U.S. Cl.
CPC ..... *D06F 2103/08* (2020.02); *D06F 2103/38* (2020.02); *D06F 2105/48* (2020.02)

(58) Field of Classification Search
USPC ..... 34/490, 595–610
See application file for complete search history.

(56) References Cited

U.S. PATENT DOCUMENTS

| | | | | |
|---|---|---|---|---|
| 9,580,860 | B2 * | 2/2017 | Bellinger | D06F 58/38 |
| 9,677,218 | B2 * | 6/2017 | Ros | D06F 58/38 |
| 11,512,420 | B2 * | 11/2022 | Park | D06F 35/005 |
| 2006/0254082 | A1 | 11/2006 | Kim | |
| 2015/0322611 | A1 | 11/2015 | Ashrafzadeh | |
| 2022/0064848 | A1 * | 3/2022 | Choe | D06F 58/04 |

FOREIGN PATENT DOCUMENTS

| | | | | |
|---|---|---|---|---|
| CN | 113195823 | A * | 7/2021 | D06F 58/04 |
| DE | 102010016875 | A1 * | 2/2011 | D06F 33/02 |
| DE | 102010017232 | A1 * | 6/2011 | D06F 58/28 |
| EP | 1669488 | | 6/2006 | |
| EP | 3124680 | | 2/2017 | |
| EP | 3901356 | A1 * | 10/2021 | D06F 58/04 |
| JP | 2008194258 | | 8/2008 | |
| KR | 1020030033900 | | 5/2003 | |
| KR | 10-2012- 0106244 | | 9/2012 | |
| KR | 1020150026549 | | 3/2015 | |
| KR | 101801572 | | 11/2017 | |
| KR | 20170125519 | | 11/2017 | |
| KR | 1020180041644 | | 4/2018 | |
| KR | 20200075538 | A * | 6/2020 | |
| WO | WO-2004048673 | A2 * | 6/2004 | D06F 58/02 |
| WO | WO-2020130567 | A1 * | 6/2020 | D06F 58/04 |

OTHER PUBLICATIONS

PCT International Search Report and Written Opinion in International Appln. No. PCT/KR2019/017869, dated Apr. 17, 2020, 7 pages.

Extended European Search Report in European Appln. No. 19897991.6, dated Aug. 16, 2022, 9 pages.

Office Action in Korean Appln. No. 10-2018-0164327, mailed on Sep. 19, 2023, 12 pages (with English translation).

* cited by examiner

DRYER CONTROL METHOD

CROSS-REFERENCE TO RELATED APPLICATIONS

This application is a National Stage application under 35 U.S.C. § 371 of International Application No. PCT/KR2019/017869, filed on Dec. 17, 2019, which claims the benefit of Korean Application No. 10-2018-0164327, filed on Dec. 18, 2018. The disclosures of the prior applications are incorporated by reference in their entirety.

TECHNICAL FIELD

The present disclosure relates to a method for controlling a dryer.

BACKGROUND

A dryer is a household appliance configured to dry a drying target object such as bedding. In the case of a conventional dryer, which supplies heated air (hot air) to a drum in which the drying target object is accommodated, air completing heat exchange with the drying target object is discharged to the outside of the drum or supplied back to the drum after removing moisture to execute the drying mode.

In the drying mode of the conventional dryer, the drum is rotated while supplying air to the drum. Thereby, the conventional dryer may shorten the drying time (and increase the efficiency of heat exchange between the drying target object and the air). However, this effect is expected only when the amount of drying target objects is small or the volume of the drying target objects is small.

That is, when the amount of drying target objects put into the drum is large, or when the amount of drying target objects put into the drum is small, but the objects include a bulky object such as a blanket, the objects may not be moved inside the drum during rotation of the drum. If the drying target objects are not moved inside the drum, a portion of the objects that is in contact with air may be dried, but a portion of the objects that hardly contacts air may not be dried.

SUMMARY

An object of the present application is to provide a method for controlling a dryer capable of increasing the exchange of heat efficiency between drying target objects and air irrespective of the amount or volume of the drying target objects.

In one aspect of the present application, provided herein is a method for controlling a dryer including a drum providing a space for storing a drying target object, a driving part configured to rotate the drum, and an air supplier configured to supply air to the drum to remove moisture from the drying target object, the method including an air supply operation of supplying air to the drum through the air supplier, a first stirring operation of controlling the driving part and causing the drum to execute a second motion and a third motion from a time when the air supply operation is started until a predetermined reference time is reached, and a second stirring operation of controlling the driving part and causing the drum to execute a first motion, the second motion, and a third motion from a time when the reference time is reached to an end time of the air supply operation.

The first motion may be configured to rotate the drum at a rotational speed allowing the drying target object to move below a horizontal line passing through a center of rotation of the drum, the third motion may be configured to rotate the drum at a rotational speed allowing the drying target object to remain in close contact with a circumferential surface of the drum, and the second motion may be configured to rotate the drum at a rotational speed higher than the rotational speed set for the first motion and lower than the rotational speed set for the third motion.

The second stirring operation may be configured to sequentially execute the first motion, the second motion, the third motion, the second motion, and the first motion.

The second stirring operation may be configured to sequentially execute the first motion, the second motion, the third motion, the second motion, the first motion, the second motion, and the third motion.

The second motion may rotate the drum at a rotational speed causing the drying target object located in a lower region below the horizontal line passing through the center of rotation of the drum to fall from an upper region above the horizontal line to the lower region.

The first stirring operation may be configured to repeat sequentially execution of the second motion and the third motion twice or more.

In the dryer control method, based on a degree of dryness of the drying target object measured by a sensor being higher than or equal to 50%, it may be determined that the reference time has elapsed.

The reference time may be set to 50 to 70 minutes from a start of the air supply operation.

The dryer control method may further include a mode selection operation of receiving a control signal related to mode selection from a user, and a drying time setting operation of setting an execution time of the air supply operation according to a mode selected by the user, wherein the reference time may be set to a time of 70% to 80% of the drying time.

The first stirring operation and the second stirring operation may be executed when the mode input in the mode selection operation is a bedding drying mode.

The present application may provide a dryer control method capable of increasing the efficiency of heat exchange between drying target objects and air irrespective of the amount or volume of the drying target objects.

DETAILED DESCRIPTION

Figure 1:
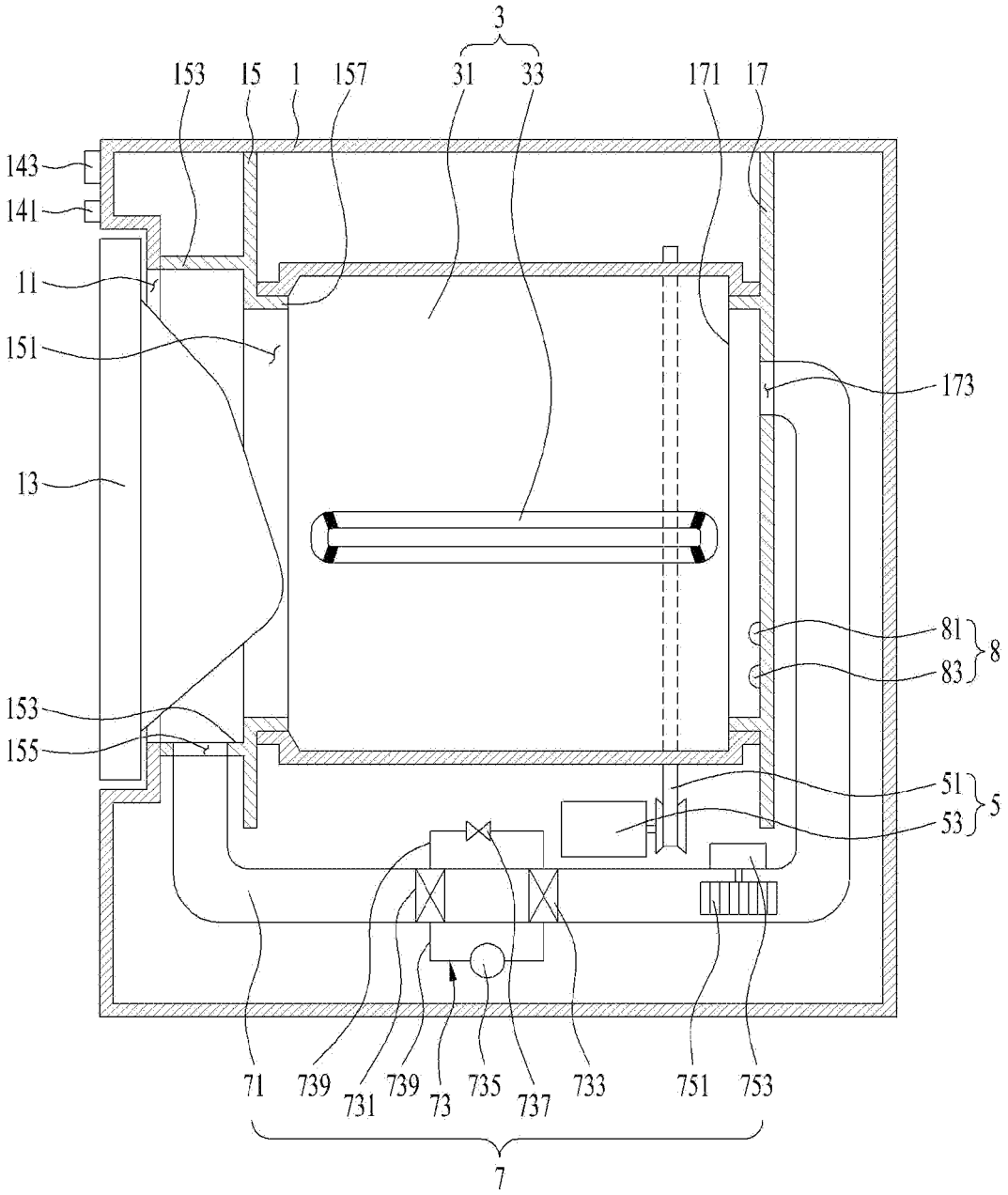
FIG. 1 shows an exemplary dryer.

Hereinafter, exemplary embodiments of a dryer control method will be described in detail with reference to the accompanying drawings. The configuration or control method of an apparatus which will be described below is merely illustrative of the embodiments of the dryer and the control method thereof, and is not intended to limit the scope of the present disclosure. Wherever possible, the same reference numbers will be used throughout the drawings to refer to the same or like parts.

A dryer 100 includes a cabinet 1, a drum 3 provided inside the cabinet to provide a space for accommodating drying target objects, a driving part 5 configured to rotate the drum, and an air supplier 7 configured to supply non-heated air or heated air (hot air) to the drum.

The cabinet 1 includes a cabinet inlet port 11 for introducing a drying target object into the drum 3 or for drawing out the drying target object stored in the drum 3 to the outside of the cabinet. The cabinet inlet port 11 is opened or closed by a door 13.

The cabinet 1 or the door 13 may be provided with a control panel configured to receive a control command from a user and to display a process of the input control command. The control panel may include an input unit 141 configured to receive a control command from the user, and a display 143 configured to display information on a process of a user-selectable control command or a control command selected by the user.

The drum 3 may include a cylindrical drum body 31 having an open front and an open rear, and a lifter (a stirring means for the drying target object) 33 protruding from a circumferential surface of the drum body toward a center of the drum body. In order to rotatably support the drum, a first support 15 configured to support the front side of the drum and a second support 17 configured to support the back side of the drum may be provided inside the cabinet 1.

The first support 15 fixed inside the cabinet 1 includes a front support 157 inserted into the front of the drum body 31, and the second support 17 fixed inside the cabinet 1 includes a rear support 171 inserted into the back of the drum body 31 to rotatably support the drum body.

The first support 15 includes an inlet port 151 allowing the cabinet inlet port 11 to communicate with the interior of the drum body 31. The inlet port 151 may be arranged in a space defined by the front support 157.

The first support 15 may be connected to the front of the cabinet 1 through a connector 153. The connector 153 may be formed in a cylindrical shape surrounding the inlet port 151 and the cabinet inlet port 11. In this case, the connector 153 is provided with an exhaust port 155 allowing the air drawn from the drum body 31 through the inlet port 151 to be discharged to the outside of the connector 153 therethrough.

The driving part 5 may be formed in any shape as long as it is capable of rotating the drum. FIG. 1 shows an exemplary case where the driving part 5 includes a motor 51 fixed inside the cabinet, and a belt 53 connecting a rotating shaft of the motor to a circumferential surface of the drum body 31.

The air supplier 7 may include a duct 71 defining a circulation passage for air, fans 751 and 753 provided inside the duct, and a heat exchanger 73 configured to dehumidify and heat the air introduced into the duct.

The duct 71 is a flow path arranged outside the drum 3 to guide the air discharged from the drum to the drum. One end of the duct may be connected to the exhaust port 155 provided in the first support, and the opposite end of the duct may be connected to an inlet 173 formed by penetrating the second support.

The fan may include an impeller 751 rotatably arranged inside the duct 71 and a fan motor 753 fixed to the exterior of the duct to rotate the impeller 751.

The heat exchanger 73 may include a refrigerant pipe 739 defining a circulation passage for a refrigerant, a first heat exchanger 731 disposed inside the duct 71 and fixed to the refrigerant pipe 739, a second heat exchanger 733 disposed inside the duct 71 and fixed to the refrigerant pipe, a compressor 735 configured to compress the refrigerant from the first heat exchanger 731 and move the same to the second heat exchanger 733, and an expansion valve 737 configured to open or close the refrigerant pipe 739 (to control the flow rate of the refrigerant) to control the pressure of the refrigerant discharged from the second heat exchanger 733.

The first heat exchanger (evaporator) 731 is configured to absorb heat from the air introduced into the duct 71. Accordingly, the air is cooled as it has through the first heat exchanger 731, and the refrigerant from the first heat exchanger 731 evaporates inside the refrigerant pipe 739. The second heat exchanger (condenser) 733 is configured to dissipate heat to the air having passed through the first heat exchanger. Accordingly, the air is heated as it passes through the second heat exchanger 733, and the refrigerant that has passed through the second heat exchanger 733 is condensed inside the refrigerant pipe.

The dryer 100 is provided with a sensor 8 configured to measure the degree of dryness of a drying target object stored in the drum body 31. any type of sensor may be used as the sensor 8 as long as it is capable of measuring the content of moisture contained in the drying target object (i.e., the ratio of water to the mass of clothing). FIG. 1 illustrates a case where the sensor 8 includes a first terminal 81 fixed to the second terminal support 17, and a second terminal 83 fixed to the second support 17 and arranged spaced apart from the first terminal.

The first terminal 81 may be connected to an positive pole of a power source, and the second terminal 83 may be connected to a negative pole of the power source. As the amount of water contained in the drying target object increases, the electrical resistance will decrease. Accordingly, as the drying degree decreases, the amount of current will be sensed by the sensor 8. When wet clothing remains in contact with the two terminals 81 and 83, current flows through the two terminals 81 and 83. Accordingly, when the controller (not shown) is configured to compare the magnitude of the current flowing through the two terminals 81 and 83 (or the magnitude of the voltage that allows the current to flow) with the magnitude of current (or the magnitude of voltage) by the degree of dryness, the dryer may determine the degree of dryness of the drying target object.

Figure 2:
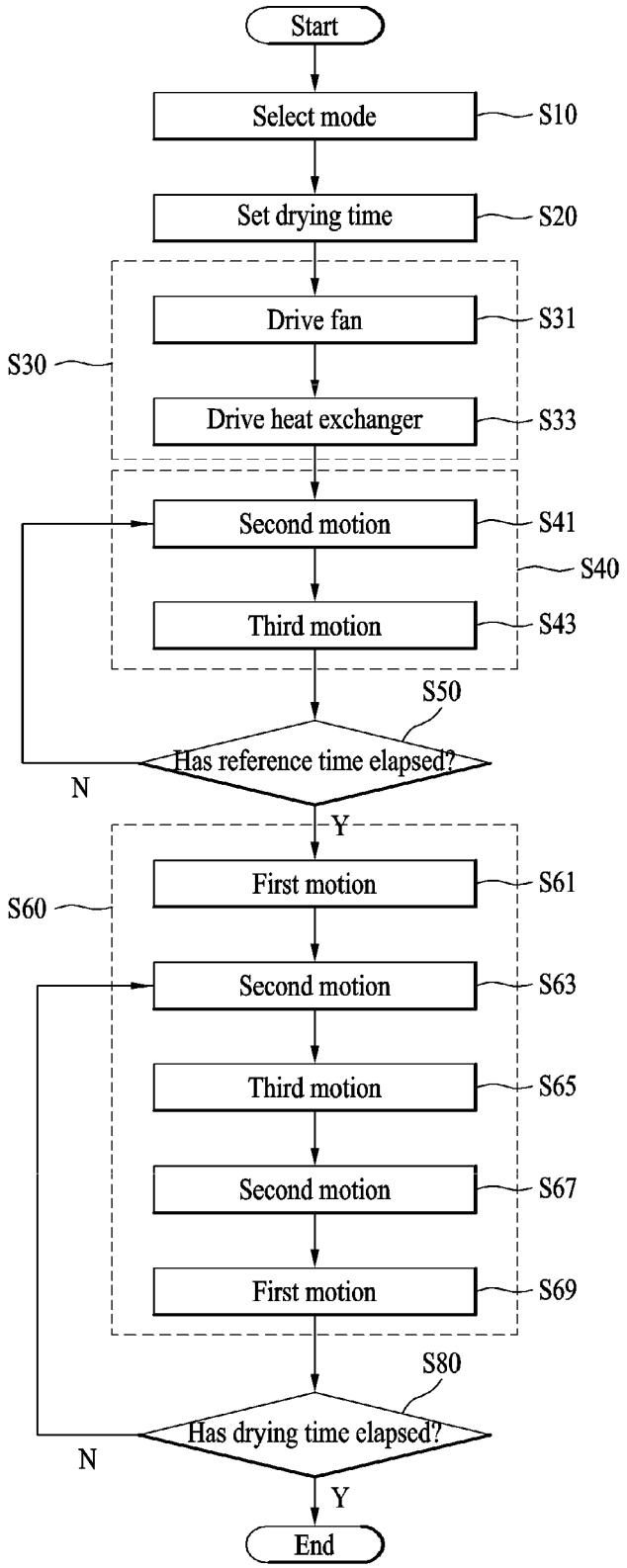
FIG. 2 illustrates an exemplary dryer control method.

FIG. 2 illustrates an exemplary control method for the dryer described above.

The dryer control method includes a mode selection operation S10 of receiving a control signal related to mode selection from a user, a drying time setting operation S20 of setting an execution time of the mode selected by the user, and an air supply operation S30 of supplying air to the drum 3 and removing moisture from a drying target object.

The mode selection operation S10 is an operation of selecting, by the user, a desired mode from among a plurality of modes displayed through a control panel or the display 413 through the input unit 141. In this operation, the controller (not shown) May determine the mode selected by the user through the control signal transmitted from the input unit 141.

The drying time setting operation S20 is an operation of setting a time required for a mode selected by the user. The drying time for each mode may be set by the controller according to the amount of drying targets put into the drum. Alternatively, the controller may select a time set for a mode selected by the user from among the drying times for the respective modes set by the manufacturer. In the former case, the dryer 100 may need to further include a sensor configured to measure the amount of the drying target objects stored in the drum.

The air supply operation S30 is an operation of causing heat exchange between the drying target objects and air by controlling the air supplier 7. The air supply operation S30 may include a fan driving operation S31 of rotating the impeller 751 by controlling the fan motor 753, and a heat exchanger driving operation S33 of sequentially performing dehumidification and heating of the air introduced into the duct 71 by controlling the heat exchanger 73.

The fan driving operation S31 and the heat exchanger driving operation S33 may be started at the same time. Alternatively, the heat exchanger driving operation S33 may be started after the start of the fan driving operation S31. Failing to supply more than a certain amount of air to the heat exchanger 73 may lead to overheating of the heat exchanger 73. When the fan driving operation and the heat exchanger driving operation are sequentially performed as in the latter case, overheating the heat exchanger may be prevented.

In the dryer control method, a stirring operation S40, S50, S60 is performed during the air supply operation S30. The stirring operation S40, S50, S60 is an operation of changing the contact area between the drying target objects and the air by moving the drying target objects inside the drum or fixing the same to the circumferential surface of the drum by adjusting the rotational speed of the drum 3.

The stirring operation includes a first stirring operation S40 and a second stirring operation S60. The first stirring operation S40 may be performed until the running time thereof reaches a preset reference time (S50). The second stirring operation S60 may be performed from the time when the running time of the air supply operation S30 reaches the reference time until the drying time set in the drying time setting operation is reached.

The second stirring operation S60 may include an operation of executing a first motion, a second motion, and a third motion by the drum 3 through the driving part 5. The first stirring operation S40 may include an operation of executing the second motion and the third motion by the drum.

Figure 3:
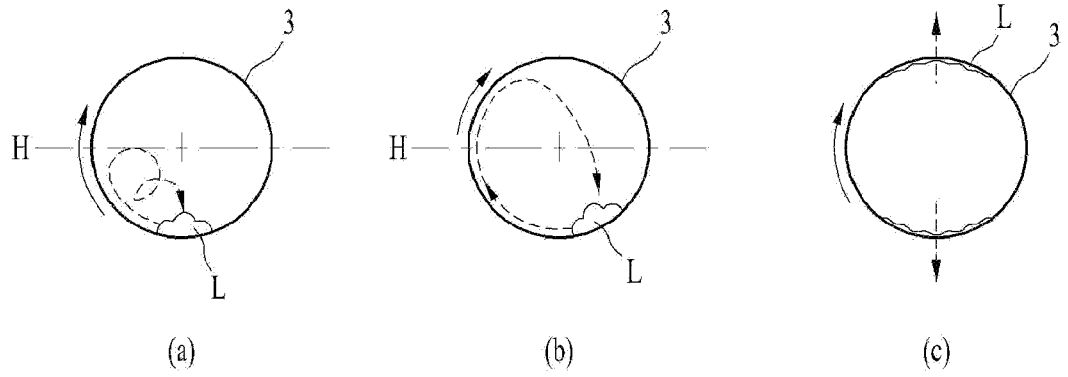
FIG. 3 shows a first motion, a second motion, and a third motion.

As shown in FIG. 3-(*a*), the first motion is to rotate the drum 3 at a first preset rotational speed, such that the drying target object L moves below a horizontal line H passing through the center of rotation of the drum 3.

When the first motion is executed, the drying target object L performs a rolling motion in a space located below the horizontal line H in the inner space of the drum 3, and accordingly the drying target object L may repeat a overturning movement through the first motion inside the drum. In other words, one surface (contact surface) of the drying target object L in contact with the circumferential surface of the drum may be separated from the circumferential surface of the drum through the first motion and be heat exchangeable with air introduced into the drum. Accordingly, the dryer control method may enable the entire area of the drying target object L to perform heat exchange with the air supplied from the air supplier 7 (and an area of the drying target object to which hot air is not supplied may be minimized) through the first motion.

As shown in FIG. 3-(*c*), the third motion is to rotate the drum 3 at a third rotational speed (a rotational speed greater than the first rotational speed) that causes centrifugal force of 1 G or more on the drying target object, such that the drying target object L is kept in close contact with the circumferential surface of the drum 3. In the third motion, the drying target object L is kept fixed to the circumferential surface of the drum by the centrifugal force, and thus does not fall although the drum 3 rotates. The third motion separates moisture contained in the drying target object from the drying target object by providing large centrifugal force to the drying target object.

The moisture contained in the drying target object will move to the circumferential surface of the drum 3 through the third motion. Accordingly, the dryer control method may minimize the required drying time through the third motion. Accordingly, in the drying time setting operation S20, the controller may set the drying time of the mode including the third motion to be shorter than the drying time of the mode without the third motion.

As shown in FIG. 3-(*b*), the second motion is to rotate the drum at a second rotational speed higher than the first rotational speed set for the first motion and lower than the third rotational speed set for the third motion. In the second motion, the drying target object L makes a movement of falling from an upper region above the horizontal line H passing through the center of rotation of the drum to a lower region below the horizontal line H.

The drying target object L located in the lower region below the horizontal line may move to the upper region above the horizontal line H through the second motion, and then fall to the lower region below the horizontal line (H) by its own weight. When the drying target object L collides with the circumferential surface of the drum, the moisture contained in the drying target object L may be easily separated from the drying target object. Accordingly, the dryer control method may minimize the drying time of the mode having the second motion.

The second stirring operation S60 may be configured to sequentially execute the first motion S61, the second motion S63, the third motion S65, the second motion S67, and the first motion S69. Combining motions in an ascending order of rotational speeds of the drum or in a descending order of rotational speeds of the drum is intended to minimize the load on the driving part 5.

The second stirring operation S60 may be repeated until the drying time ends. In other words, when it is determined that the drying time has elapsed from the start of the air supply operation S30, the control method ends the second stirring operation and the air supply operation (S80).

However, when it is determined that the drying time has not elapsed from the start of the air supply operation S30 (S80), the second stirring operation S60 may be configured such that operations subsequent to the second motion S63 are performed after the end of the first motion S69.

As shown in FIG. 2, the first stirring operation S40 may be configured as an operation of executing the second motion and the third motion from the start of the air supply operation S20 until a reference time is reached.

The first motion is skipped in the first stirring operation S40 because it is not easy to achieve the effect of the first motion in the first stirring operation S40. The first stirring operation S40 is performed at the beginning of the air supplying operation S30. Accordingly, the drying target object L at the time of the first stirring operation S40 has high moisture content (a low degree of dryness). When the drum is rotated in the first motion with the moisture content of the drying target object being high, the tendency for the drying target object to maintain close contact with the circumferential surface of the drum is enhanced due to the moisture contained in the drying target object, and therefore the movement as shown in FIG. 3-(*a*) is not implemented even when the drum is rotated at the first rotational speed.

The first stirring operation S40 may be configured to repeat sequentially execution of the second motion S41 and the third motion S43 twice or more. That is, the first stirring operation S40 may be configured to sequentially perform the second motion, the third motion, the second motion, and the third motion. This is intended to minimize the load on the driving part 5.

The reference time may be set to 50 minutes to 70 minutes from the start of the air supply operation S30, and or may be set to the time when the degree of dryness of the drying target object measured by the sensor 8 is 50% to 60%. In the latter case, when the degree of dryness measured by the sensor is 50% to 60%, the controller may determine that the reference time has been reached.

Alternatively, the reference time may be set to a time of 70% to 80% of the drying time set in the drying time setting operation S20. For example, when the drying time in the mode selected by the user is set to 80 minutes, the reference time may be set to 56 minutes to 64 minutes.

The above-described stirring operations S40, S50, and S60 are more effective in a mode for drying bedding such as a blanket (a bedding drying mode). Because bedding such as blankets is thick and bulky, the bedding hardly moves inside the drum even when the drum rotate. When the air supplier 7 supplies air into the drum while the position of the bedding is not changed, a part of the bedding that contacts the air may be dried, but the parts of the bedding that do not contact with the air may not be dried. By executing the stirring operations S40, S50, and S60 when the bedding drying mode is selected, the above-described issue may be addressed.

Although the control method has been described based on a dryer having a circulation type drying system as shown in FIG. 1, the control method may also be applied to a dryer having an exhaust type drying system. A dryer with the exhaust type drying system includes a drum 3, an exhaust duct for discharging the air from the drum to the outside of the cabinet, a supply duct for supplying external air to the drum, a fan provided in the exhaust duct, and a heat exchanger (heater) provided to the supply duct. The control method is applicable to a dryer having such an exhaust type drying system.

The above-described dryer and the control method therefor may be modified and implemented in various forms, and the scope of the present application is not limited to the above-described embodiments.

What is claimed is:

1. A method for controlling a dryer including a drum providing a space for storing a drying target object, a driving part configured to rotate the drum, and an air supplier configured to supply air to the drum to remove moisture from the drying target object, the method comprising:

an air supply operation of supplying air to the drum through the air supplier;

a first stirring operation of controlling the driving part and causing the drum to execute a second motion and a third motion from a time when the air supply operation is started until a predetermined reference time is reached; and a second stirring operation of controlling the driving part and causing the drum to execute a first motion, the second motion, and the third motion from a time when the reference time is reached to an end time of the air supply operation;

wherein:

the first motion is configured to rotate the drum at a rotational speed allowing the drying target object to move below a horizontal line passing through a center of rotation of the drum;

the third motion is configured to rotate the drum at a rotational speed allowing the drying target object to remain in close contact with a circumferential surface of the drum; and the second motion is configured to rotate the drum at a rotational speed higher than the rotational speed set for the first motion and lower than the rotational speed set for the third motion.

2. The method of claim 1, wherein the second stirring operation is configured to sequentially execute the first motion, the second motion, the third motion, the second motion, and the first motion.

3. The method of claim 1, wherein the second stirring operation is configured to sequentially execute the first motion, the second motion, the third motion, the second motion, the first motion, the second motion, and the third motion.

4. The method of claim 1, wherein the second motion rotates the drum at a rotational speed causing the drying target object located in a lower region below the horizontal line passing through the center of rotation of the drum to fall from an upper region above the horizontal line to the lower region.

5. The method of claim 1, wherein the first stirring operation is configured to sequentially repeat execution of the second motion and the third motion two or more times.

6. The method of claim 5, wherein the reference time is set based on a degree of dryness of the drying target object measured by a sensor being higher than or equal to 50%.

7. The method of claim 5, wherein the reference time is set to 50 to 70 minutes from a start of the air supply operation.

8. The method of claim 5, further comprising:

a mode selection operation of receiving a control signal related to mode selection from a user; and a drying time setting operation of setting an execution time of the air supply operation according to a mode selected by the user, wherein the reference time is set to a time of 70% to 80% of the drying time.

9. The method of claim 8, wherein the first stirring operation and the second stirring operation are executed when the mode input in the mode selection operation is a bedding drying mode.

* * * * *